US005877590A

United States Patent [19]

Fukuyo et al.

[11] Patent Number: 5,877,590

[45] Date of Patent: Mar. 2, 1999

[54] DISCHARGE LAMP ARC TUBE AND METHOD OF PRODUCING THE SAME

[75] Inventors: Takeshi Fukuyo; Shinichi Irisawa; Nobuo Ohkawai, all of Shizuoka, Japan

[73] Assignee: Koito Manufacturing Co., Ltd., Tokyo, Japan

[21] Appl. No.: 891,345

[22] Filed: Jul. 12, 1996

[30] Foreign Application Priority Data

Jul. 12, 1996 [JP] Japan ..... 8-182958

[51] Int. Cl.[6] ..... H01J 61/36; H01J 9/32

[52] U.S. Cl. ..... 313/623; 313/624; 313/625

[58] Field of Search ..... 313/623, 624, 313/625

[56] References Cited

U.S. PATENT DOCUMENTS

| | | | |
|---|---|---|---|
| 3,211,826 | 10/1965 | Holcomb et al. | 174/50.64 |
| 4,254,300 | 3/1981 | Thompson-Russell | 313/331 |
| 5,277,639 | 1/1994 | Nagata et al. | 445/26 |
| 5,286,227 | 2/1994 | Numajiri et al. | 445/26 |
| 5,310,374 | 5/1994 | Tomoyuki | 313/623 |
| 5,505,648 | 4/1996 | Nagasawa et al. | 445/26 |
| 5,606,141 | 2/1997 | Leichtfried | 313/341 |

FOREIGN PATENT DOCUMENTS

| | | |
|---|---|---|
| 0309749 | 4/1989 | European Pat. Off. . |
| 0492189 | 7/1992 | European Pat. Off. . |
| 1207221 | 9/1970 | United Kingdom . |

OTHER PUBLICATIONS

Database WPI Section Ch, Derwent Publications Ltd., London, GB; Class L03, An 72–53267T XP002053388 & JP 47 031 575 B (Tokyo Shibaura Electric Co) *Abstract No Date.

Database WPI, Section Ch, Derwent Publications Ltd., London, GB; Class L03, AN 72–80184T XP002053389 & JP 47 048 749 B (Tokyo Shibaura Electric Co) Abstract No Date.

Database WPI Section Ch, Week 8611, Derwent Publications Ltd., London, GB; Class L03, An 86–074635 XP002053390 & SU 1 174 999 A (Light Eng Techn Res) Aug. 23, 1985, Abstract.

Patent Abstracts of Japan, vol. 010, No. 175 (E–413), Jun. 20, 1986 & Jp 61 024125 A (Matsushita Denshi Kogyo KK), Feb. 2, 1986, Abstract.

*Primary Examiner*—Nimeshkumar D. Patel

*Attorney, Agent, or Firm*—Sughrue, Mion, Zinn, Macpeak & Seas, PLLC

[57] ABSTRACT

A discharge lamp arc tube comprises: a glass tube having a linear extension portion, a closed glass bulb, and pinch seal portions at both sides of the closed glass bulb; and electrode assemblies, each having an electrode rod, a molybdenum foil and a lead wire integrally series-connected, the molybdenum foil having oxide films thereon, wherein the electrode assemblies are inserted into the glass tube and pinch-sealed such that the molybdenum foils are positioned at the respective pinch seal portions.

1 Claim, 4 Drawing Sheets

DISCHARGE LAMP ARC TUBE AND METHOD OF PRODUCING THE SAME

BACKGROUND OF THE INVENTION

The present invention relates to a discharge lamp arc tube having a closed glass bulb containing electrodes arranged to be opposite to each other and luminous materials, etc., sealed therein, especially relates to an arc tube having a closed glass bulb without any tip-off portion, and a method of producing the same.

FIG. 6 shows a conventional discharge lamp device. The discharge lamp device has a structure in which front and rear end portions of an arc tube 5 are supported by a pair of lead supports 3 and 4 projecting forward from an electrically insulating base 2. The reference character G designates an ultraviolet screening globe for cutting off an ultraviolet component in a wavelength region harmful to human bodies from light emitted from the arc tube 5.

The arc tube 5 has a structure in which a closed glass bulb 5*a* is formed between a pair of front and rear sides pinch seal portions 5*b*, 5*b* such that a pair of electrode rods 6, 6 are disposed so as to be opposite to each other in the glass bulb 5*a* by the pinch seal portions 5*b*, 5*b* respectively and luminous materials are sealed in the glass bulb 5*a*. A piece of molybdenum foil 7 which connects the electrode rod 6 projected into the inside of the closed glass bulb 5*a* and a lead wire 8 led out from the pinch seal portion 5*b* to each other is sealed in the pinch sealed portion 5*b*, so that the airtightness in each of the pinch seal portions 5*b* is secured.

That is, tungsten rods excellent in durability are most suitably used as the electrode rods 6 but tungsten is largely different in linear expansion coefficient from glass and inferior in airtightness because tungsten is hardly fitted to glass. Accordingly, molybdenum foil 7 having a linear expansion coefficient close to that of glass and relatively well fitted to glass, is connected to each of the tungsten electrode rods 6 and sealed by each of the pinch seal portions 5*b* so that airtightness in each of the pinch seal portions 5*b* is secured.

A method for producing the arc tube 5 is disclosed, for example, in Japanese Patent Application Laid-open No. Hei. 6-231729. As shown in FIG. 7(*a*), first, an electrode assembly A including an electrode rod 6, a piece of molybdenum foil 7 and a lead wire 8 to which the rod 6 and the foil 7 are integrally connected is inserted into a cylindrical glass tube W from one opening end side of the glass tube W. The glass tube W has a spherically swollen portion $w_2$ formed in the middle of the glass tube W, that is, between linear extension portions $w_1$. A position $P_1$ near the spherically swollen portion $w_2$ is primarily pinch-sealed. Then, as shown in FIG. 7(*b*), luminous materials P, etc., are introduced into the spherically swollen portion $w_2$ from the other opening end side of the glass tube W. Then, as shown in FIG. 7(*c*), after another electrode assembly A is inserted, a position $P_2$ near the spherically swollen portion $w_2$ is heated and secondarily pinch-sealed while the spherically swollen portion $w_2$ is cooled by liquid nitrogen so that the luminous materials, etc., are not vaporized. In this manner, the spherically swollen portion $w_2$ is sealed hermetically, so that an arc tube 5 having a tipless closed glass bulb 5*a* is finished.

Incidentally, in the primary pinch sealing step shown in FIG. 7(*b*), pinch-sealing is performed while an inert gas (generally, inexpensive argon gas) is supplied, as a forming gas, into a glass tube W so that the electrode assemblies A are not oxidized. Further, in the secondary pinch sealing step shown in FIG. 7(*c*), pinch-sealing is performed in a nearly vacuum state because the glass tube W with its opening ends closed is cooled by liquid nitrogen so that luminous materials, etc., are not vaporized.

In the conventional arc tube, however, the linear expansion coefficient of the molybdenum foil 7 sealed by the pinch seal portions 5*b* is not quite equal to that of glass even though the molybdenum foil 7 is well fitted to glass. Further, the temperature difference of the lamp is large between at the time of switching on and at the time of switching off, so that heat stress due to the temperature change is generated in the interface between the molybdenum foil 7 and glass. Further, the vibration of an engine and vibration due to the running of a car are transmitted to the arc tube. Accordingly, there arises a problem that a gap is formed between the molybdenum foil 7 and a glass material in long-term use, that is, foil floating occurs to cause the leakage of materials sealed in the closed glass bulb.

Therefore, the present inventor conducted experiments and made considerations on the aforementioned problems. As a result, the inventor confirmed that foil floating was reduced if molybdenum foil having its surface oxidized was sealed in the pinch-seal portion. Thus, the inventor has achieved the present invention.

That is, the present invention is based on the aforementioned problems and the inventor's findings and its object is to provide a discharge lamp arc tube free from foil floating in pinch seal portions and a method of producing the same.

SUMMARY OF THE INVENTION

To achieve the foregoing object, according to a first aspect of the invention, the discharge lamp arc tube comprises electrode assemblies, each of which is constituted by an electrode rod, a piece of molybdenum foil and a lead wire integrally series-connected, wherein the electrode assemblies are inserted into a glass tube from opposite opening ends of the glass tube, regions of the glass tube including the pieces of molybdenum foil are pinch-sealed to form a closed glass bulb in which luminous materials, etc., are sealed and electrodes are disposed so as to be opposite to each other, and oxide films are formed on surfaces of the piece of molybdenum foil fixedly sealed in each of the pinch seal portions. An Mo—O—S intermediate layer formed between the molybdenum layer and the glass layer serves as an adhesive layer to firmly stick the molybdenum layer to the glass layer and also serves to absorb various kinds of stress such as heat stress, etc., generated in the interface between molybdenum and glass due to the difference in linear expansion coefficient between molybdenum and glass.

According to a second aspect of the invention, in the discharge lamp arc tube described above, the quantity of surface oxidation of the molybdenum foil is in a range of from 15% by weight to 80% by weight. If the quantity of surface oxidation of the molybdenum foil is not larger than 15% by weight, there is no effect for prevention of foil floating. On the other hand, if the quantity of surface oxidation is not smaller than 80% by weight, the molybdenum foil is oxidized up to the inside of the molybdenum foil to reduce mechanical strength and durability of the molybdenum foil to thereby bring about a disadvantage such as foil disconnection, or the like. Accordingly, the quantity of surface oxidation of the molybdenum foil is preferably selected to be in a range of from 15% by weight to 80% by weight.

According to a third aspect of the invention, a method of producing an arc tube comprises the steps of: inserting an electrode assembly, which has an electrode rod, a piece of molybdenum foil and a lead wire integrally series-connected, into a glass tube from one opening end of the glass tube; primarily pinch-sealing a region of the glass tube containing the piece of molybdenum foil; introducing luminous materials, etc., into the glass tube from the other opening end of the glass tube; inserting another electrode assembly, has another electrode rod, another piece of molybdenum foil and another lead wire integrally series-connected, into the glass tube from the other opening end of the glass tube; and secondarily pinch-sealing another region of the glass tube containing the other piece of molybdenum foil to thereby produce an arc tube having a closed glass bulb containing the electrodes disposed so as to be opposite to each other and the luminous materials, etc., sealed therein; wherein, in the primary pinch-sealing step, a surface of the piece of molybdenum foil is oxidized while a forming gas is supplied into the glass tube and, in the secondary pinch-sealing step, a surface of the other piece of molybdenum foil is oxidized before the other electrode assembly is inserted into the glass tube.

According to a fourth aspect of the invention, in the discharge lamp arc tube producing method according to the third aspect, the forming gas supplied into the glass tube comprises an inert gas such as argon gas, or the like, in order to prevent excessive oxidation of the electrode assemblies; and air in the neighborhood of opening ends of the glass tube is made to flow into the glass tube by an ejector function with the inflow of the forming gas into the glass tube to thereby supply oxygen into the glass tube. When the inner diameter of the forming gas supply nozzle inserted into the glass tube from the opening end of the glass tube is selected to be smaller than the inner diameter of the glass tube, air in the neighborhood of the opening end of the glass tube is made to flow into the glass tube by the ejector function to thereby contribute to oxidation of the molybdenum foil.

According to a fifth aspect of the invention, in the method of producing a discharge lamp arc tube described in the third aspect, the forming gas supplied into the glass tube is adjusted in advance so that a small amount of oxygen is contained in an inert gas such as argon, or the like, in order to prevent excessive oxidation of the electrode assemblies. In the secondary pinch-sealing step, a forming gas having components adjusted to contain oxygen in advance may be used.

According to a sixth aspect of the invention, a method of producing a discharge lamp arc tube comprises the steps of: inserting an electrode assembly which has an electrode rod, a piece of molybdenum foil and a lead wire integrally series-connected, into a glass tube from one opening end of the glass tube; primarily pinch-sealing a region of the glass tube containing the piece of molybdenum foil; introducing luminous materials, etc., into the glass tube from the other opening end of the glass tube; inserting another electrode assembly which has another electrode rod, another piece of molybdenum foil and another lead wire integrally series-connected, into the glass tube from the other opening end of the glass tube; and secondarily pinch-sealing another region of the glass tube containing the other piece of molybdenum foil to thereby produce an arc tube having a closed glass bulb containing the electrodes disposed so as to be opposite to each other and the luminous materials, etc., sealed therein; wherein, in the primary and secondary pinch-sealing steps, surfaces of the pieces of molybdenum foil are oxidized before the electrode assemblies are inserted into the glass tube. Electrode assemblies each containing molybdenum foil having its surface oxidized may be prepared in advance as electrode assemblies used in the primary and secondary pinch-seal sides.

BRIEF DESCRIPTION OF THE DRAWINGS

FIG. 5(*a*) is a view for explaining the primary pinch-sealing step; FIG. 5(*b*) is a view for explaining the step of introducing luminous materials, etc; FIG. 5(*c*) is a view for explaining the tipping-off step; and FIG. 5(*d*) is a view for explaining the secondary pinch-sealing step;

DETAILED DESCRIPTION OF THE PREFERRED EMBODIMENTS

Embodiments of the present invention will be described below.

Figure 1:
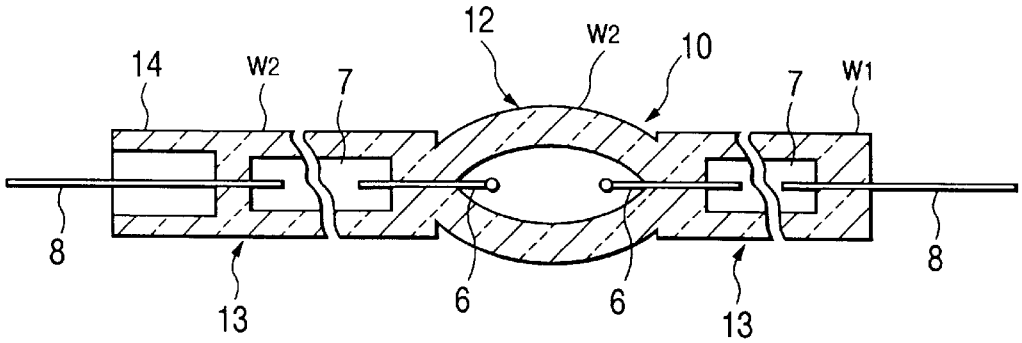
FIG. 1 is a vertical sectional view of an arc tube as an embodiment of the present invention.
Figure 2:
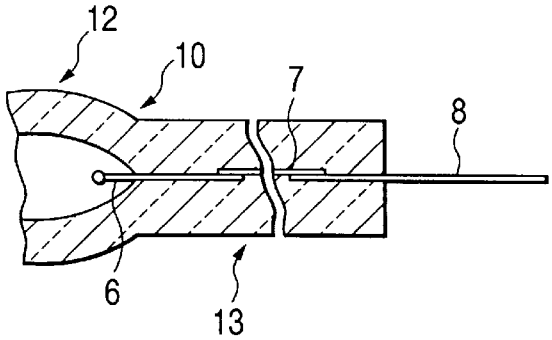
FIG. 2 is a horizontal sectional view of a pinch seal portion of the arc tube.
Figure 3:
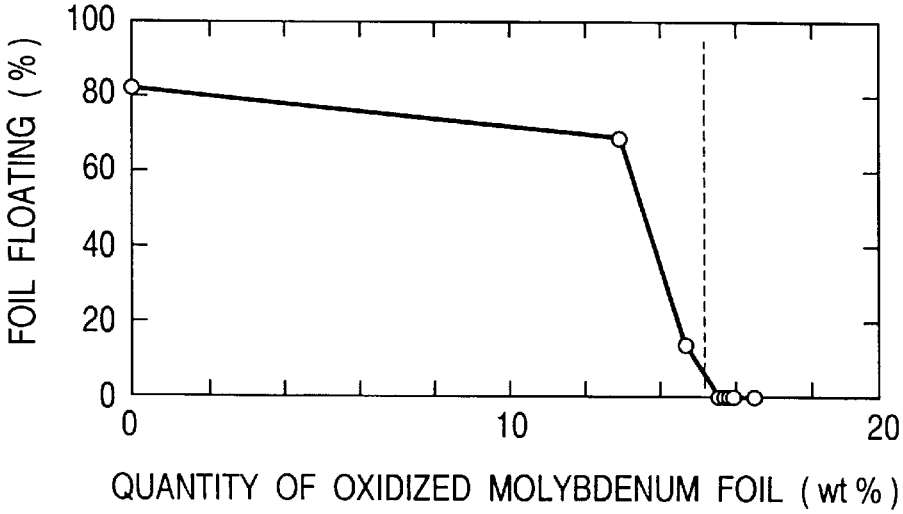
FIG. 3 is a graph showing the relation between the quantity of oxidation of molybdenum foil sealed in the pinch seal portion and the incidence of foil floating.
Figure 4:
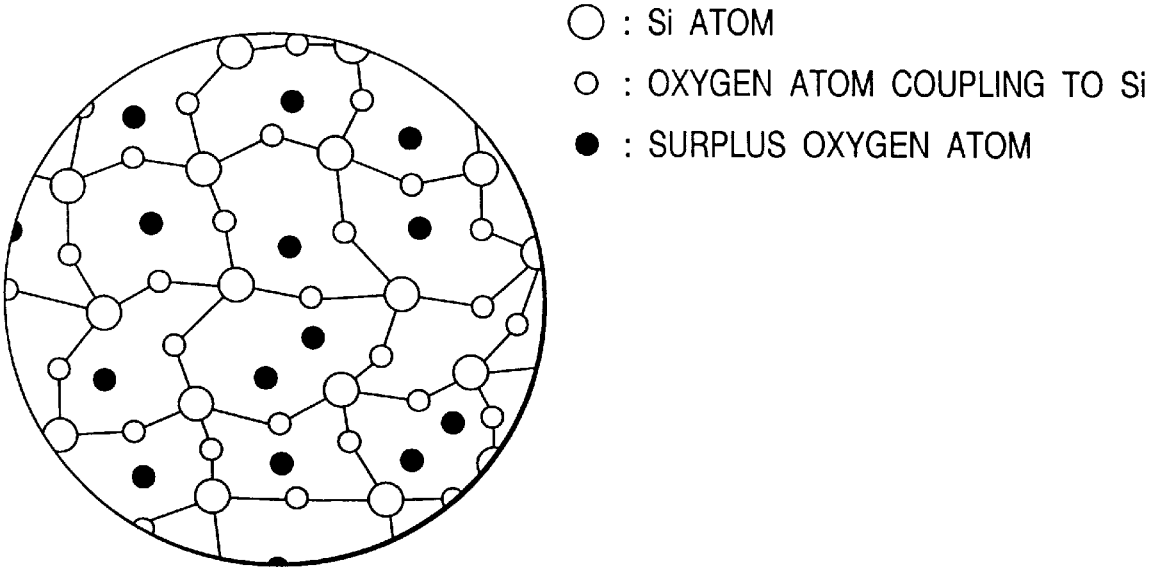
FIG. 4 is a view showing the atomic arrangement structure on a surface of molybdenum foil.
Figure 5A:
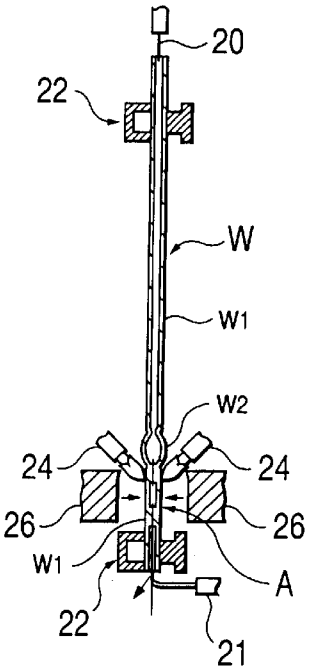
FIGS. 5(*a*) to 5(*d*) are views for explaining an arc tube producing process.
Figure 5B:
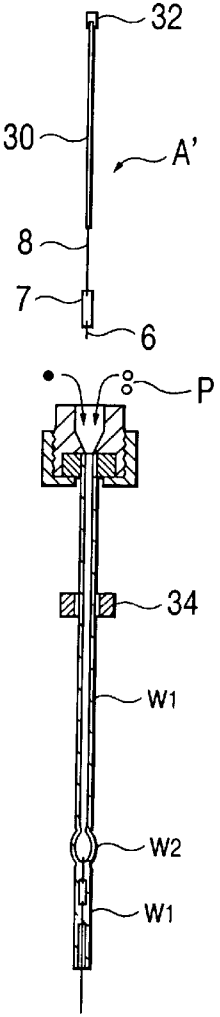
Figure 5C:
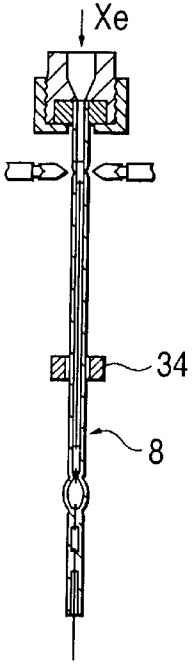
Figure 5D:
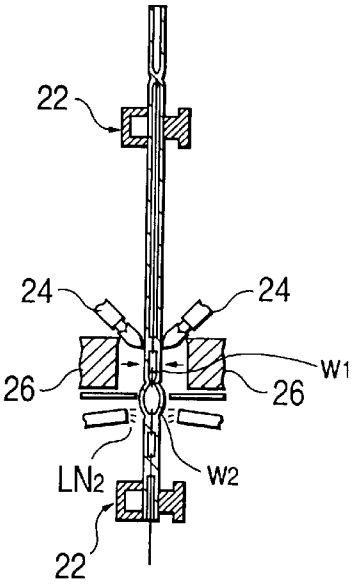

FIGS. 1 to 5 show an embodiment of the present invention. FIG. 1 is a vertical sectional view of a discharge lamp arc tube which is an embodiment of the present invention; FIG. 2 is a horizontal sectional view of a pinch seal portion of the arc tube; FIG. 3 is a graph showing the relation between the quantity of oxidized molybdenum foil sealed in the pinch seal portion and the incidence of foil floating; FIG. 4 is a view showing the atomic arrangement structure on a surface of the molybdenum foil; and FIG. 5 is a view for explaining a process of producing the arc tube.

Figure 6:
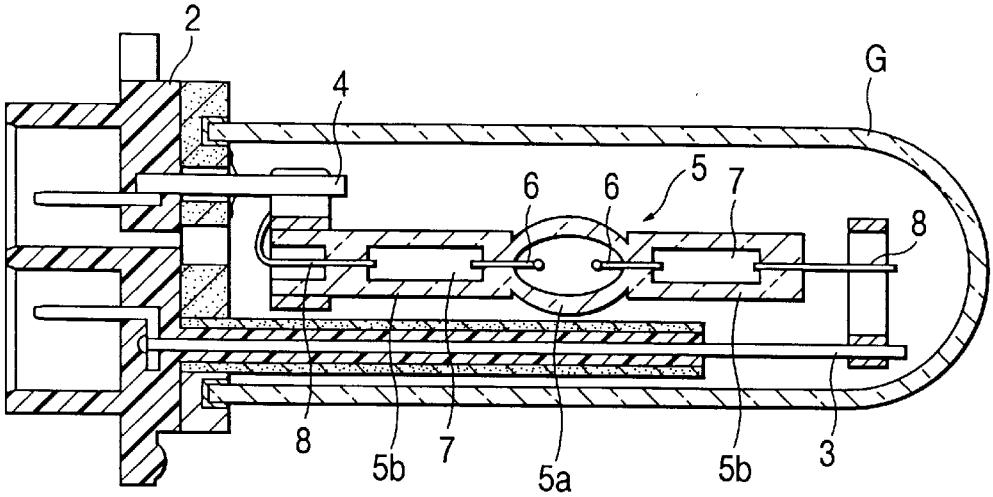
FIG. 6 is a sectional view of a conventional discharge lamp.

In these drawings, a discharge lamp device to which an arc tube 10 is attached has the same structure as the conventional structure shown in FIG. 6, and the description thereof will be therefore omitted here.

The arc tube 10 has a structure in which a round-pipe-like quartz glass tube W having a spherically swollen portion $w_2$ formed in the longitudinal middle of a linear extension portion $w_1$ is pinch-sealed at portions near the spherically swollen portion $w_2$ so that pinch seal portions 13, 13 rectangularly shaped in cross section are formed in opposite end portions of an ellipsoidal tipless closed glass bulb 12 forming a discharge space. Starting rare gas, mercury and metal halide (hereinafter referred to as "luminous materials, etc.") are sealed in the closed glass bulb 12.

A pair of tungsten electrode rods 6, 6 constituting discharge electrodes are disposed in the closed glass bulb 12 so as to be opposite to each other. The electrode rods 6, 6 are connected to pieces of molybdenum foil 7 sealed in the pinch seal portions 13, respectively. Molybdenum lead wires 8 connected to the pieces of molybdenum foil 7 are led out from the end portions of the pinch seal portions 13, respectively. The rear end side lead wire 8 passes through a round-pipe-like portion 14, which is a pinchless seal portion, and extends to the outside.

The external appearance structure of the arc tube 10 shown in FIG. 1 is not apparently different from the conventional arc tube 5 shown in FIG. 6. However, in this embodiment, the pinch-sealed molybdenum foil 7 is coated with an oxide film (in a range of from 15% by weight to 80% by weight of the quantity of oxidized molybdenum foil) on its surface so that foil floating never occurs in the pinch seal portions 13 even in use for a long time.

That is, the molybdenum foil 7 having its surface oxidized is pinch-sealed to thereby form an Mo—O—Si intermediate layer in the interface between the molybdenum foil and quartz glass. By the presence of the Mo—O—Si intermediate layer, not only the molybdenum layer is firmly bonded to the glass layer but also various kinds of stress such as heat stress, etc., acting on the interface between molybdenum and quartz glass due to the difference in linear expansion coefficient between molybdenum and quartz glass, is absorbed. As a result, foil floating never occurs.

FIG. 3 shows the relation between the quantity of oxidized molybdenum foil fixedly sealed in a pinch seal portion of the arc tube and the incidence of foil floating. This relation has been obtained from experiments conducted by the present inventor.

That is, in the step shown in FIG. 5(*a*) which will be described later in detail, an electrode assembly A is inserted into a glass tube W so as to be disposed therein. While a forming gas is supplied from a forming gas (argon gas) supply nozzle 20 inserted into the glass tube W, a predetermined pinch-seal portion of the glass tube W is sufficiently heated by a burner 24. The operation of a pincher 26 is stopped just before the glass tube W is pinch-sealed by the pincher 26. After the glass tube W is cooled while a forming gas (argon gas) is supplied, the electrode assembly A is taken out. The aperture of the nozzle 20 in this step is changed variously so that the quantity of air taken into the glass tube W by an ejector function is changed. Alternatively, a forming gas adjusted in advance to contain a small amount of oxygen is used. Consequently, the degree of oxidation of molybdenum foil to be pinch-sealed is changed.

Further, oxygen (O) and silicon (S) in the center position of the molybdenum foil are analyzed by EPMA and compared with a standard sample to thereby be quantified.

The relation between the quantity of oxidation of the Mo foil obtained by the aforementioned analysis and the incidence of foil floating is examined. As a result, data (71% for 12.86% by weight of oxide, 18% for 14.48% by weight of oxide, 0% for 15.54% by weight of oxide, 0% for 15.81% by weight of oxide, and 0% for 16.54% by weight of oxide) as shown in FIG. 3 are obtained.

As seen from FIG. 3, the incidence of foil floating decreases as the quantity of oxidization in the surface of the Mo foil increases. With 13 to 15% by weight of oxide in the surface of the Mo foil as a boundary, the incidence of foil floating is reduced from 70% to 0%.

Further, it is considered that the atomic arrangement on the oxidized Mo foil surface is such that surplus oxygen atoms (O) contributing to oxidation of Mo are dispersed in $SiO_2$ lattices which are formed from quartz glass heated and vaporized by the burner and aggregated onto the Mo foil surface, as shown in FIG. 4. Further, it is considered that the mechanism of adhesion between Mo foil and quartz glass in the pinch seal portion is such that molybdenum oxide ($MoO_2$ or $MoO_3$) generated by the oxidation of a part of the Mo foil reacts with quartz glass ($SiO_2$) or Mo ions are diffused in an $SiO_2$ crystal to thereby form an Mo—O—Si intermediate layer in the interface of adhesion to perform firm vacuum airtight adhesion. Further, it is considered that the force of adhesion between Mo foil and quartz glass increases to thereby prevent the occurrence of foil floating as the quantity of oxidation of the Mo foil surface increases.

The occurrence of foil floating becomes difficult as the quantity of oxidation of the Mo foil surface increases. If the quantity of oxidation is not smaller than 80% by weight, however, the Mo foil is oxidized up to its inside and becomes fragile so as to be inferior in mechanical strength and durability. Accordingly, the quantity of oxidation of the Mo foil surface is preferably not larger than 80% by weight.

The process of producing the arc tube having the tipless closed glass bulb 12 shown in FIG. 1 will be described below with reference to FIG. 5.

First, a glass tube W having a spherically swollen portion $w_2$ formed in the middle of a linear extension portion $w_1$ is produced in advance. As shown in FIG. 5(*a*), a forming gas (argon gas) supply nozzle 20 is inserted into the glass tube W from an upper opening end of the glass tube W while the glass tube W is held vertically and an electrode assembly A is inserted into the glass tube W from a lower end opening and held in a predetermined position. This forming gas is to keep the inside of the glass tube W in a pressurized state at the time of pinch-sealing and to prevent the electrode assembly from being oxidized. The reference numeral 22 designates a glass tube-gripping member.

A position (containing the molybdenum foil) of the linear extension portion $w_1$ near the spherically swollen portion $w_2$ is then heated by the burner 24 and primarily pinch-sealed by the pincher 26 while the forming gas is supplied into the glass tube W through the nozzle 20. The reference numeral 21 designates a forming gas (argon gas) supply nozzle disposed toward the lower end portion of the glass tube W so that a lead wire 8 led out of the glass tube W is prevented from being oxidized.

The inner diameter of the nozzle 20 is selected to be smaller than the inner diameter of the glass tube W so that a gap is formed between the glass tube W and the nozzle 20. Therefore, in the primary pinch-sealing step shown in FIG. 5(*a*), a negative pressure is generated in the neighborhood of the pointed end portion of the nozzle 20 in the glass tube W with the inflow of the forming gas into the glass tube W, so that air in the neighborhood of the opening end of the glass tube W flows into the glass tube W. That is, air in the neighborhood of the opening end of the glass tube W is taken into the glass tube W by the ejector function. The air taken into the glass tube W then flows down, together with the forming gas, into the glass tube W and is discharged out of the glass tube W from the lower end opening of the glass tube W. Accordingly, the electrode assembly A in the glass tube W is exposed to the forming gas (argon gas) containing air (oxygen) and oxidized so that a molybdenum oxide layer is formed on the surface of the molybdenum foil 7. The quartz glass tube W heated and softened is pinched so that the molybdenum foil having its surface oxidized (in the oxidization proportion in a range of from 15% by weight to 80% by weight) by contact with the air-containing forming gas for a predetermined time is sealed in the pinch seal portion 13. The pinch seal portion 13 is structured so that the molybdenum foil and the quartz glass are firmly integrally adhered to each other by the MO—O—Si intermediate layer formed between the molybdenum foil and the glass.

Then, as shown in FIG. 5(*b*), luminous materials P, etc., are introduced into the spherically swollen portion $w_2$ from the upper end opening of the glass tube W. Then, another electrode assembly A' having molybdenum foil 7 with its surface which has been oxidized in advance (in the oxidation proportion in a range of from 15% by weight to 80% by weight) is inserted into the glass tube W from its upper end opening and held in a predetermined position. The reference numeral 30 designates an iron alloy lead wire integrated by spot-welding to a lead wire of the electrode assembly A'. A piece of molybdenum foil 32 as lead wire is integrally spot-welded to the other end portion of the lead wire 30. If a magnet 34 is moved along the glass tube W, the electrode assembly A' with lead wire can be moved to a predetermined position so as to be held thereat.

After the glass tube W is evacuated, a predetermined upper region of the glass tube W is tipped off while Xe gas is supplied, as shown in FIG. 5(*c*). Thus, the assembly A' with lead wire is temporarily fixed and luminous materials, etc., are sealed in the glass tube W.

As shown in FIG. 5(*d*), a position (containing the molybdenum foil) of the linear extension portion $w_1$ near the spherically swollen portion $w_2$ is then heated by means of the burner 24 and secondarily pinch-sealed by means of the pincher 26 while the spherically swollen portion $w_2$ is cooled by liquid nitrogen ($LN_2$) so that the luminous materials P, etc., are not vaporized. Thus, the spherically swollen portion $w_2$ is sealed hermetically to thereby complete a glass tube having a tipless closed glass bulb 12 containing electrodes arranged so as to be opposite to each other and containing luminous materials P, etc., sealed therein. That is, the molybdenum foil 7 of the electrode assembly A' to be inserted into the secondary pinch seal side is oxidized in advance (in the oxidation proportion in a range of from 15% by weight to 80% by weight) so that a molybdenum oxide layer is formed on the surface of the molybdenum foil 7. In the secondary pinch-sealing step, the quartz glass tube W heated so as to be softened is pinch-sealed so that the molybdenum foil 7 is sealed in the pinch seal portion 13. Further, an Mo—O—Si intermediate layer is formed between the molybdenum foil and the glass layer in the pinch seal portion 13 so as to make the molybdenum foil and the glass layer that firmly integrally adhere to each other. Finally, the end portion of the glass tube is cut off by a predetermined length to obtain such an arc tube 10, as shown in FIG. 1.

Although the aforementioned embodiment has been described about the case where argon gas is used as the forming gas supplied into the glass tube, any inert gas such as $H_2$ gas, $N_2$ gas, Kr gas, Xe gas, etc., may be used.

Figures 7A, 7B, 7C:
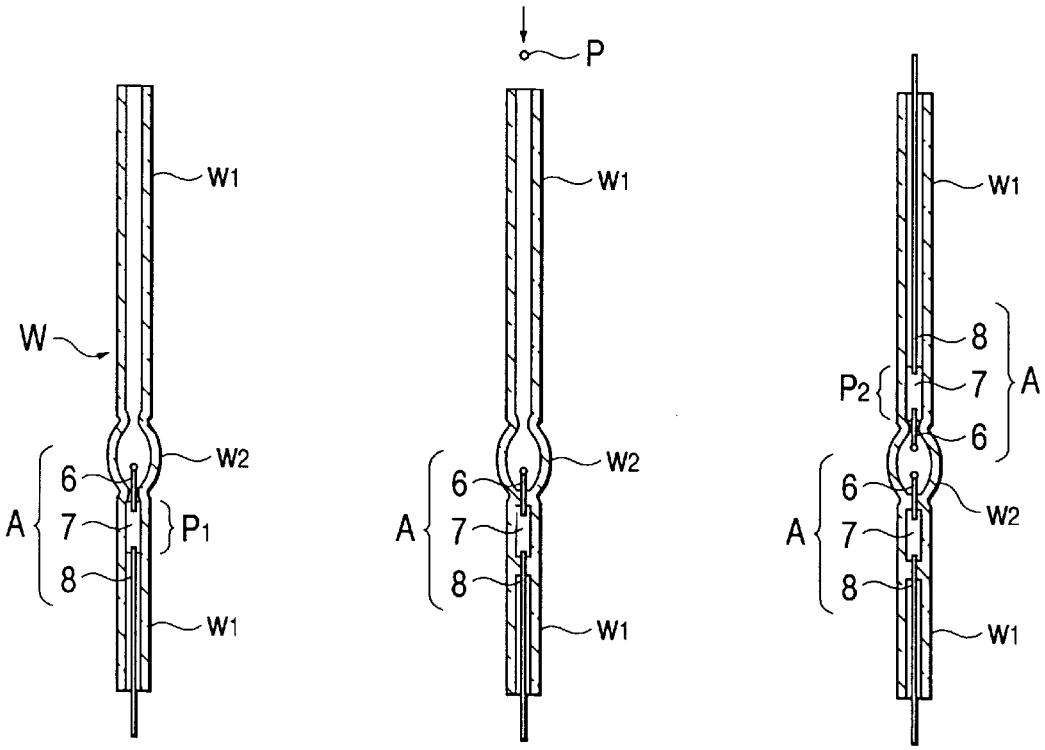
FIGS. 7(*a*) to 7(*c*) are views for explaining a conventional arc tube producing process.

Although the aforementioned embodiment has been described about the case where the glass tube is tipped off to thereby enclose luminous materials, etc., in the glass tube after the primary pinch-sealing and before the secondary pinch-sealing, the glass tube may be directly pinch-sealed without any tipping-off after the primary pinch-sealing to thereby seal luminous materials, etc., in the glass tube in the same manner as in the conventional step shown in FIG. 7(*c*).

Although the aforementioned embodiment has described about the case where a method in which air is positively taken into the glass tube by means of the ejector function with the supply of the forming gas into the glass tube is employed as a method for oxidizing the primary pinch-seal side molybdenum foil, a method in which a predetermined amount of oxygen ($O_2$) is mixed in the forming gas in advance to adjust the constituent components of the gas, or a method in which surface oxidation is applied to the primary pinch-seal side molybdenum foil in advance in the same manner as in the secondary pinch-seal side molybdenum foil, may be used.

As apparent from the above description, in the discharge lamp device arc tube according to the present invention, not only molybdenum foil and glass are made to firmly integrally adhere to each other but also various kinds of stress generated in the interface of adhesion is absorbed and reduced by the presence of an Mo—O—Si intermediate layer formed between the molybdenum layer and the glass layer in the pinch seal portion. Foil floating is eliminated even in use for a long time. Accordingly, stable electric discharge is guaranteed for a long time.

According to the second aspect, foil floating is eliminated securely, so that stable electric discharge is securely guaranteed for a long time.

In the arc tube producing method according to the third aspect, the respective steps in the conventional arc tube producing method can be used with little change so that surface-oxidized molybdenum foil can be sealed in a pinch seal portion. Accordingly, an arc tube in which stable electric discharge can be guaranteed for a long time can be provided inexpensively.

According to the fourth aspect, in the primary pinch-sealing step, air in the neighborhood of the opening end of the glass tube is taken into the glass tube so that molybdenum foil is oxidized by the ejector function while the forming gas is supplied into the glass tube. Accordingly, the primary pinch-seal side molybdenum foil is oxidized automatically in the series of arc-tube producing process. Because the arc tube producing process is little different from the conventional process, an arc tube in which stable electric discharge can be guaranteed for a long time can be provided inexpensively.

According to the fifth aspect, in the primary pinch-sealing step, a gas which is adjusted so that a small amount of oxygen is contained in an inert gas effective for prevention of oxidation of electrode assemblies is used as a forming gas. Accordingly, the primary pinch-seal side molybdenum foil is oxidized automatically in the series of arc tube producing process. Because the arc-tube producing process is little different from the conventional process, an arc tube in which stable electric discharge can be guaranteed for a long time can be provided inexpensively.

In the arc tube producing method according to the sixth aspect, electrode assemblies each containing surface-oxidized molybdenum foil are prepared in advance as electrode assemblies used for the primary and secondary pinch-seal sides. Accordingly, the quantity of surface oxidation of molybdenum foil sealed in the pinch-seal portion can be managed to be always kept constant, so that arc tubes free from foil floating, excellent in durability and having substantially uniform characteristic can be mass-produced.

What is claimed is:

1. A discharge lamp arc tube comprising:

a glass tube having a linear extension portion, a closed glass bulb, and pinch seal portions at both sides of the closed glass bulb; and electrode assemblies, each having an electrode rod, a molybdenum foil and a lead wire integrally series-connected, the molybdenum foil having oxide films thereon, wherein the electrode assemblies are inserted into the glass tube and pinch-sealed such that the molybdenum foils are positioned at the respective pinch seal portions, and wherein a quantity of oxidation of the molybdenum foil is in a range of from 15% by weight to 80% by weight.

* * * * *

UNITED STATES PATENT AND TRADEMARK OFFICE

CERTIFICATE OF CORRECTION

PATENT NO. : 5,877,590

DATED : March 2, 1999

INVENTOR(S) : Takeshi FUKUYO, Shinichi IRISAWA, Nobuo OHKAWAI

It is certified that error appears in the above-identified patent and that said Letters Patent is hereby corrected as shown below:

ON THE TITLE PAGE

Item [22] FILED section, delete "Jul. 12, 1996" and insert --Jul. 10, 1997--.

Signed and Sealed this

Sixteenth Day of May, 2000

*Attest:*

Q. TODD DICKINSON

*Attesting Officer*

*Director of Patents and Trademarks*